United States Patent [19]

Hannen

[11] Patent Number: 4,616,471

[45] Date of Patent: Oct. 14, 1986

[54] METHOD OF PACKAGING A PALLET-SUPPORTED STACK OF GOODS

[75] Inventor: Reiner W. Hannen, Goch, Fed. Rep. of Germany

[73] Assignee: MSK-verpackungs-Systeme Gesellschaft mit beschrankter Haftung, Kleve, Fed. Rep. of Germany

[21] Appl. No.: 637,522

[22] Filed: Aug. 3, 1984

[30] Foreign Application Priority Data

Aug. 3, 1983 [DE] Fed. Rep. of Germany ..... 3327996

[51] Int. Cl.[4] ..... B65B 53/06

[52] U.S. Cl. ..... 53/442

[58] Field of Search ..... 53/442, 557, 469, 570

[56] References Cited

U.S. PATENT DOCUMENTS

| | | | |
|---|---|---|---|
| 3,581,458 | 6/1971 | Gustavsson | 53/557 X |
| 3,589,510 | 6/1971 | Begnaud et al. | 53/557 X |
| 3,662,512 | 5/1972 | Zelnick | 53/557 X |
| 3,807,126 | 4/1974 | Schwarz | 53/442 |
| 3,853,218 | 12/1974 | Grasvoll | 53/442 X |
| 3,930,790 | 1/1976 | Rogosch | 53/442 X |
| 4,258,533 | 3/1981 | Aka et al. | 53/557 |

FOREIGN PATENT DOCUMENTS 3200832 7/1983 Fed. Rep. of Germany .

*Primary Examiner*—Horace M. Culver

*Attorney, Agent, or Firm*—Karl F. Ross; Herbert Dubno

[57] ABSTRACT

Tight packaging of a load including a stack of goods mounted on a pallet is achieved by lifting the loaded pallet above a conveyor or other supporting surface, pulling a hood of heat-shrinkable plastic foil from above over the load with the rim of the hood projecting below the underside of the pallet, heating that rim to substantially shrinkage temperature for causing it to contract around the pallet periphery, and lowering the load onto the supporting surface to press the hot, contracted hood rim against the bottom of the pallet. The contraction is aided by a blower below the pallet aspirating air toward the center thereof. The remainder of the hood is then thermally shrunk around the load.

3 Claims, 3 Drawing Figures

METHOD OF PACKAGING A PALLET-SUPPORTED STACK OF GOODS

FIELD OF THE INVENTION

My present invention relates to a method of packaging a pallet-supported stack of goods, referred to hereinafter as a pallet load, by tightly enveloping same in a hood of heat-shrinkable plastic sheet material, usually polyethylene.

BACKGROUND OF THE INVENTION

Commonly owned German published specification No. DE-OS 32 00 832 describes an apparatus for wrapping a pallet load in such a hood which is slipped from above around the stack so that a lower marginal portion or rim projects below the underside of the pallet. With the pallet elevated above a supporting surface such as that of a conveyor, a suction fan is actuated to aspirate air from below the underside of the pallet so as to draw the surrounding marginal portion inward, causing it to fold around the pallet edge. This folding is assisted by a pair of bell cranks swinging horizontally on the conveyor, underneath diagonally opposite corners of the raised pallet, serving to smooth the bent-over rim of the hood.

After this wrapping operation, and with the fan still running, the pallet load is lowered onto the conveyor. Consequently, the folded rim becomes clamped between the pallet and the conveyor surface. Thereafter, the load is moved to a heating station in which the hood is thermally shrunk around the stack and the pallet, e.g. as described in my copending application Ser. No. 566,330 filed Dec. 28, 1983 (now U.S. Pat. No. 4,562,689).

Such a system has the disadvantage of utilizing two separate stations so that a considerable amount of space is required, aside from the necessary structures and control mechanisms. Furthermore, the overlapping layers of sheet material on the underside of the pallet are difficult to heat-seal to a satisfactory degree as these layers are not uniformly heated in their clamped position.

OBJECT OF THE INVENTION

It is thus the object of my present invention to provide a method of and an apparatus for tightly wrapping a pallet load in a heat-shrinkable envelope with avoidance of the aforestated drawbacks.

SUMMARY OF THE INVENTION

I realize this object, in accordance with the present invention, by using heat preferably together with suction—rather than mechanical means—for contracting the projecting rim of a downwardly open hood around the periphery of the pallet while the latter is elevated above its supporting surface. Advantageously, this is performed with the same equipment that is subsequently used, after a lowering of the pallet onto the supporting surface to clamp the bent-over and thermally fused rim in position, for completing the shrinkage of the hood around the pallet load. Clamping takes place while the bent-over rim is still at or close to the shrinkage temperature of the plastic sheet material even as the heating device employed, which may be a frame-shaped or annular burner spacedly surrounding the load, rises toward the top of the package.

In order to insure an optimum folding and adhering of the sheet material to the underside of the pallet, air is advantageously aspirated from below the latter before and during lowering of the load onto its support—e.g. a roller conveyor—as known per se from the German publication identified above. The fan or blower generating this suction may be reversible for temporarily inflating the anchored hood around the stack in order to prevent fusion to the goods, as described in my copending application referred to.

Thus, my invention does not necessitate the use of two separate processing stations so that the entire packaging process can be performed at one and the same site.

BRIEF DESCRIPTION OF THE DRAWING

The above and other features of my present invention will now be described in detail with reference to the accompanying drawing in which.

SPECIFIC DESCRIPTION

Figure 3:
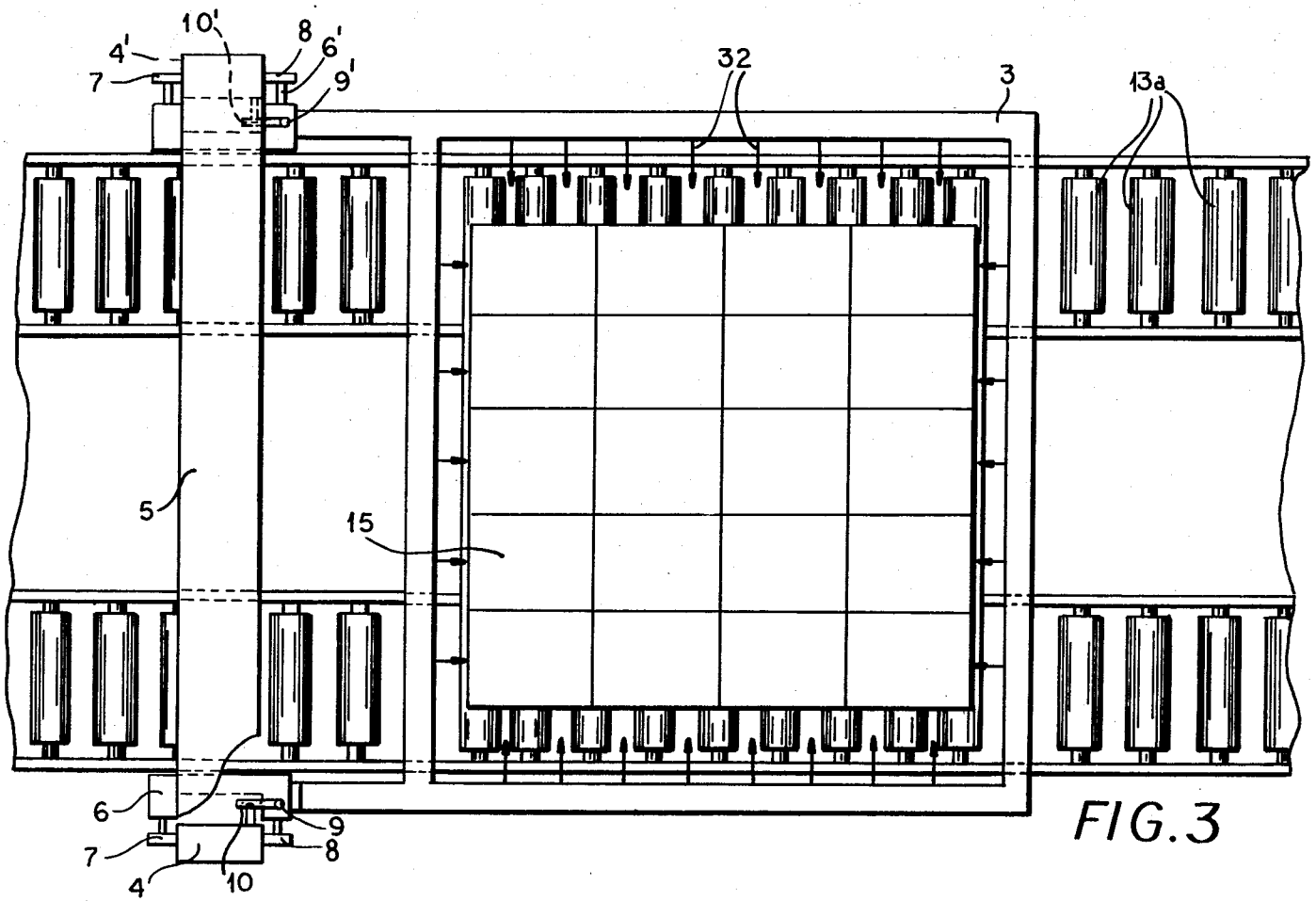
FIG. 3 is a top view of the apparatus.

In the drawing, I have shown a packaging station 1 for wrapping a pallet load of stacked goods 12 in a heat-shrinkable hood 30 of polyethylene foil. Station 1 comprises a portal 2 which includes a pair of horizontally spaced-apart uprights 4, 4' interconnected at the top by a crossbar 5 while resting on a base 31. Each upright 4, 4' is provided with an endless chain 9, 9' running along the entire height thereof and carrying a respective hoisting block 6, 6'. The chains, as particularly illustrated for the upright 4, are guided around sprocket wheels 10, 11 respectively disposed at the upper and the lower end of the upright. A reversible motor (not shown), coupled with sprockets 10 and 10', is operable to raise and lower a burner 3 in the shape of a hollow rectangular frame which is cantilevered on blocks 6 and 6'. The latter, as shown for block 6, are provided with two rollers 7, 8 which are vertically offset and engage opposite sides of the upright 4 to hold the burner 3 horizontal. A gas fed into the burner at blocks 6, 6' is heated therein and discharged in a multiplicity of hot streams from inwardly facing orifices as indicated by arrows 32 in FIG. 3.

Figure 1:
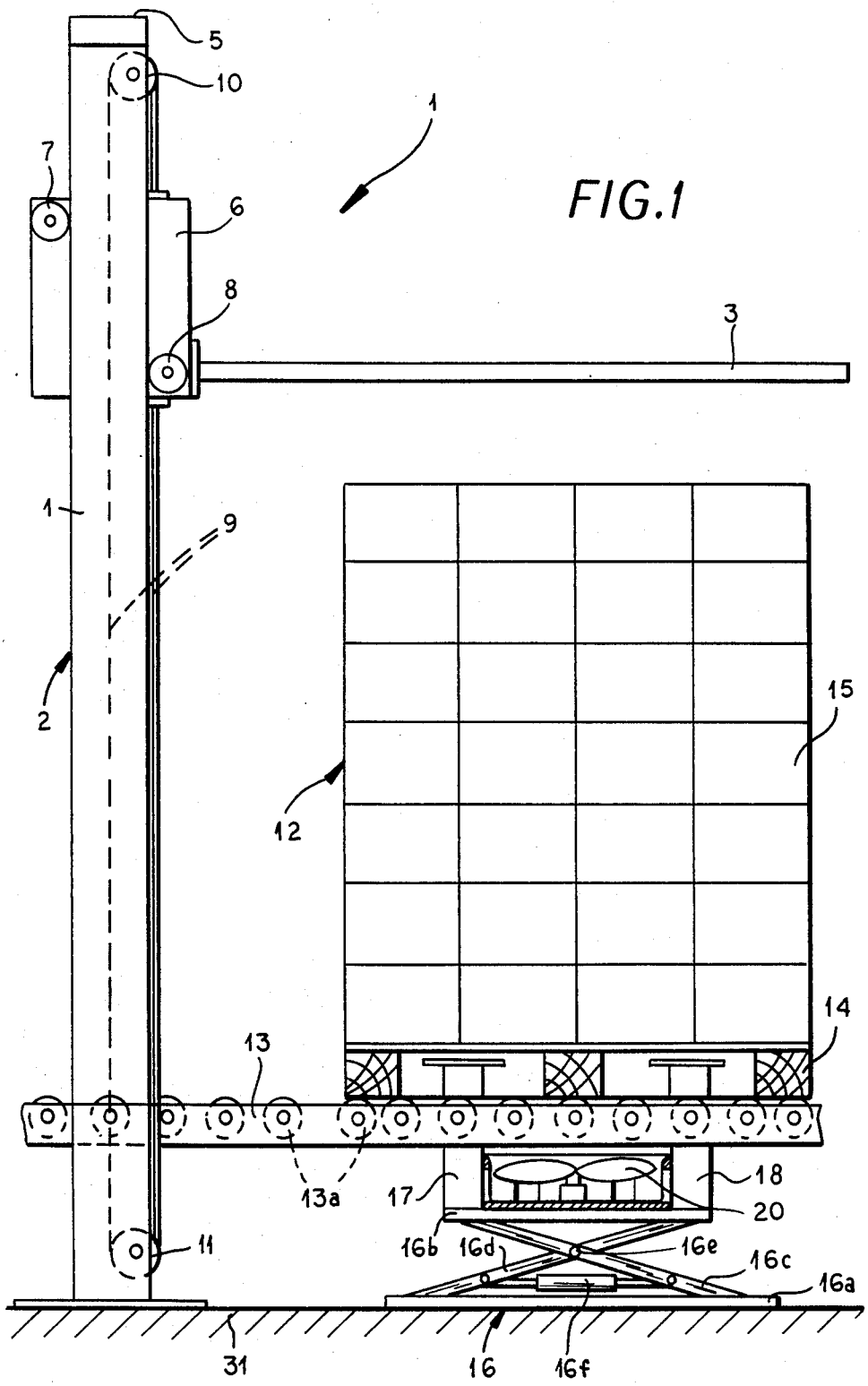
FIG. 1 is a side-elevational view of an apparatus embodying the invention, illustrating a heater and a pallet load in a first position.

Base 31 is spacedly overlain by a set of rollers **13*a* which constitute a conveyor for transporting a load 12 to be packaged, consisting of a stack of goods 15 mounted on a pallet 14, from a pallet-loading station to a heating zone surrounded by burner 3. Inside that heating zone, a lifting device 16 of the scissor-linkage type lies between base 31 and roller conveyor 13, this device having scissor arms 16*c*, 16*d* articulated to each other at 16*e* as well as to a bottom plate 16*a* and a top plate 16*b* in which the ends of these arms are slidably received. A fluidic jack 16*f* interconnects arms 16*c* and 16*d* to raise the upper plate 16*b* upon being activated in a contractile sense; plate 16*b* carries plungers 17, 18 which pass through clearances between rollers 13*a* and extend from below into the body of pallet 14, engaging the top of that pallet from within. In the normal position illustrated in FIG. 1, with jack 16*f* expanded, pallet 14 is lowered onto roller conveyor 13. Upon being lifted to the level of FIG. 2, in which pallet 14 lies above the burner 3** shown to be in its lowermost position, the underside of the pallet is spaced from the roller conveyor by a distance of, say, 15 cm.

Figure 2:
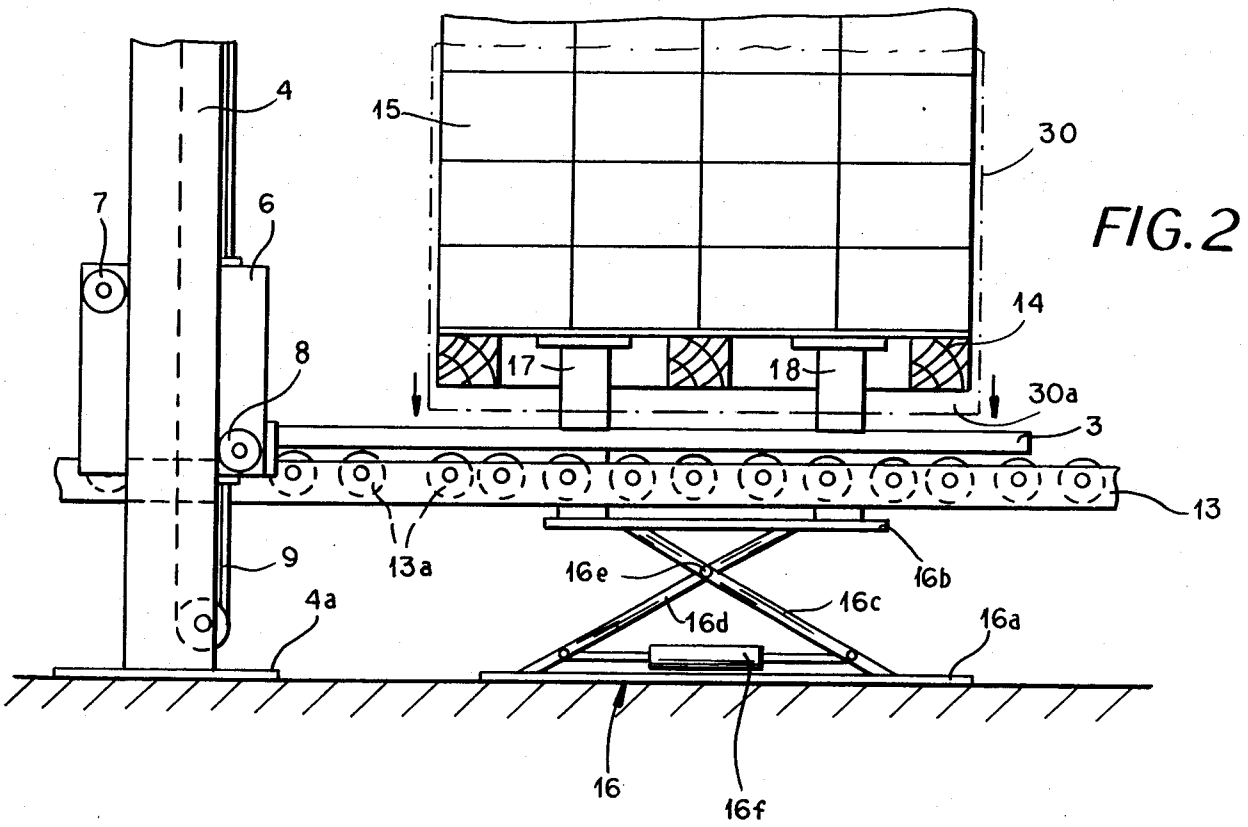
FIG. 2 is a fragmentary side-elevational view similar to that of FIG. 1, illustrating the heater and the pallet load in a second position.

FIG. 2 further shows the hood 30 pulled down around stack 15 and pallet 14 so that its lower rim 30*a* projects for a significant distance below the underside of that pallet. A blower 20, carried on plate 16*b*, generates radially inward suction below pallet 14 within the region encompassed by the depending rim or skirt 30*a* of hood 30. This suction, together with hot gases 32 trained upon that rim by the activated burner 3, causes peripheral portions of the rim to fold inward all along the circumference of the pallet against its underside as seen in FIG. 2. Hood 30 is pulled over the load 12 from above, after a raising of pallet 14, by a wrapping machine known per se and not illustrated; the machine is then retracted whereupon the load is lowered into the position of FIG. 1 in which the bent-over portions of rim 30*a* are clamped between rollers 13*a* and pallet 14. As the rim 30*a* is still at or near its shrinking temperature, it adheres under that clamping pressure to the pallet so as to seal the hood 30 from below.

After the removal of the wrapping machine, burner 3 is gradually raised by hoisting blocks 6, 6*a* to the top of stack 15 so that hood 30 is completely shrunk onto the load which can then be rolled out of the heating station on conveyor 13. Another, similar load is thereupon treated in the same manner.

I claim:

1. A method of tightly packaging a load including a stack of goods mounted on a pallet, comprising the steps of:

(a) moving the load to be packaged onto a supporting surface inside a heating zone;

(b) elevating said load above said supporting surface;

(c) pulling a hood of heat-shrinkable plastic foil from above over the elevated load, with a lower rim of said hood projecting downward below the underside of said pallet;

(d) initially blowing hot gases substantially only against the lower hood rim from an annular burner surrounding the rim in the heating zone and thereby heating only said lower rim to shrinking temperature for contracting same around the periphery of said pallet;

(e) with said rim still at substantially shrinking temperature clamping bent-over portions thereof against the underside of said pallet; and (f) only thereafter shrinking the remainder of said hood around said load by raising the annular burner up around the load.

2. A method as defined in claim 1 wherein step (e) involves a lowering of said load onto said supporting surface for clamping said bent-over portions between said pallet and said supporting surface.

3. A method as defined in claim 1 wherein the contraction of said rim in step (d) is aided by radially inward suction generated underneath said pallet.

* * * * *